US011225780B2

(12) United States Patent
Spöler et al.

(10) Patent No.: US 11,225,780 B2
(45) Date of Patent: Jan. 18, 2022

(54) DRINKING AND SERVICE WATER SYSTEM AND METHOD FOR FLUSHING SAME

(71) Applicant: Gebr. Kemper GmbH + Co. KG Metallwerke, Olpe (DE)

(72) Inventors: Thomas Spöler, Bergisch Gladbach (DE); Manuel Schuppert, Lennestadt (DE)

(73) Assignee: GEBR. KEMPER GMBH + CO., KG METALLWERKE, Olpe (DE)

( * ) Notice: Subject to any disclaimer, the term of this patent is extended or adjusted under 35 U.S.C. 154(b) by 85 days.

(21) Appl. No.: 16/750,346

(22) Filed: Jan. 23, 2020

(65) Prior Publication Data

US 2020/0248437 A1 Aug. 6, 2020

(30) Foreign Application Priority Data

Jan. 31, 2019 (DE) ..... 102019201263.9

(51) Int. Cl.
*E03B 1/00* (2006.01)
*E03B 7/08* (2006.01)
(Continued)

(52) U.S. Cl.
CPC ..... *E03B 7/08* (2013.01); *E03B 7/04* (2013.01); *E03B 7/078* (2013.01)

(58) Field of Classification Search
CPC ..... E03B 7/006; E03B 7/071; E03B 7/08
See application file for complete search history.

(56) References Cited

U.S. PATENT DOCUMENTS 4,688,273 A * 8/1987 Lyng ..... E03C 1/023 4/668
8,402,984 B1 * 3/2013 Ziegenbein ..... E03B 7/071 137/15.11

(Continued)

FOREIGN PATENT DOCUMENTS

DE 20120156 U1 12/2001
DE 102006017807 A1 10/2007

(Continued)

OTHER PUBLICATIONS

EP Search Report from EP Application No. EP 20153854 dated Jun. 4, 2020.
German Search Report dated Oct. 16, 2019 from DE 102019201263.9.

*Primary Examiner* — Reinaldo Sanchez-Medina
(74) *Attorney, Agent, or Firm* — Fay Sharpe LLP

(57) ABSTRACT

The present invention refers to a drinking and service water system with a connection (2) to the public water supply network, at least one supply line (4, 6) leading to at least one consumer (8), a flushing valve (10) downstream of the consumer (8) in the flow direction for draining water from the drinking and service water system, a control unit (12) connected to the flushing valve (10) in terms of control, and a first temperature sensor (18) upstream of the consumer (8) in the flow direction, the control unit (12) comprising a flushing module which determines flushing processes to the control unit (12) at specific times and/or at specific time intervals. This invention is intended to provide a drinking and service water system which, with an efficient flushing device, fulfills the hygienic requirements placed on a drinking water system. To solve the problem, a second temperature sensor (20) is arranged between the consumer (8) and the flushing valve (10) and the control unit (12) is arranged to decide whether the predetermined flushing operation is to (Continued)

be suspended or postponed on the basis of a temperature difference between a measured value of the first temperature sensor (18) and a measured value of the second temperature sensor (20). In a secondary aspect, the present invention provides a method for flushing such a system.

17 Claims, 1 Drawing Sheet

(51) Int. Cl.
*E03B 7/04* (2006.01)
*E03B 7/07* (2006.01)

(56) References Cited

U.S. PATENT DOCUMENTS

| | | | | |
|---|---|---|---|---|
| 2012/0204981 | A1* | 8/2012 | Coerdt | E03B 7/04 137/563 |
| 2013/0306157 | A1* | 11/2013 | Aylon | E03B 7/07 137/1 |
| 2017/0254052 | A1* | 9/2017 | Bartenstein | G01K 13/02 |
| 2019/0330091 | A1* | 10/2019 | Hank | C02F 9/00 |
| 2020/0190781 | A1* | 6/2020 | Spoler | E03B 7/006 |

FOREIGN PATENT DOCUMENTS

| | | | |
|---|---|---|---|
| DE | 102010055176 | A1 | 7/2012 |
| DE | 102011013955 | A1 | 9/2012 |
| DE | 102014208261 | A1 | 11/2015 |
| EP | 2365141 | A2 | 9/2011 |
| EP | 2722449 | A1 | 4/2014 |
| EP | 3214230 | A1 | 9/2017 |
| GB | 2496640 | A | 5/2013 |

* cited by examiner

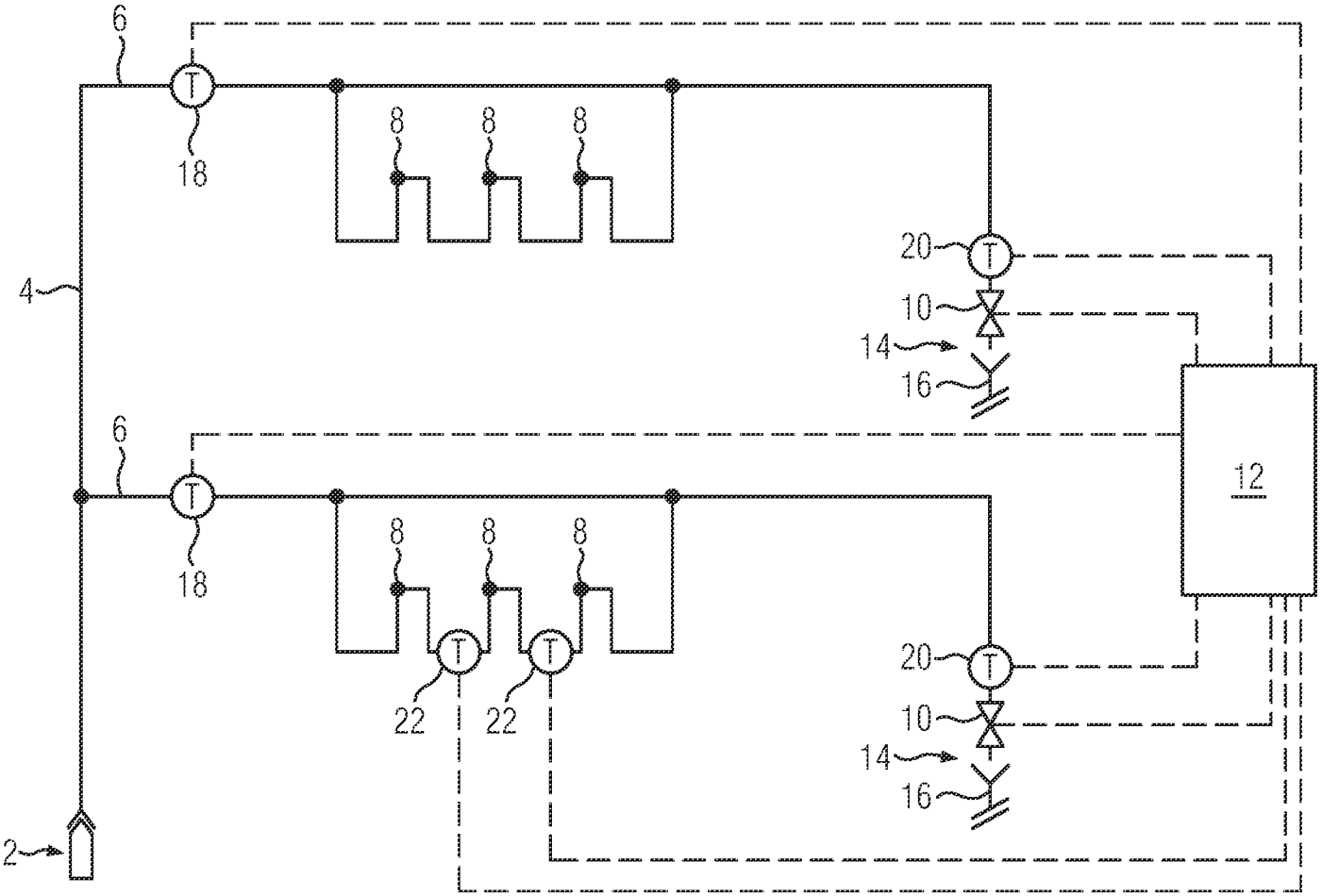
12
20
10
14
16
20
10
14
16
8
8
8
8
8
8
22
22
18
18
6
6
4
2

DRINKING AND SERVICE WATER SYSTEM AND METHOD FOR FLUSHING SAME

This application claims priority to German Patent Application Serial No. 102019201263.9 filed Jan. 31, 2019, the entirety of which is fully incorporated by reference herein.

The present invention refers to a drinking and service water system with the generic features of claim 1. Such a drinking and service water system is known from DE 20 2008 002 822 U1 of the applicant. The present invention also refers to a method for flushing such a system.

The known drinking and service water system has a connection to the public water supply network in the basement of a building. Via this connection, a plurality of supply lines are supplied with fresh water to supply various water consumers within the building. In the absence of a water withdrawal by a consumer, stale water in the supply lines can be drained via a flushing valve into a sewer pipeline. The flushing valve is provided at one end of the supply line(s) and in terms of control is connected to a central control unit. In particular, the position of the flushing valve can be controlled by means of a motor cable. This motor cable is usually connected indirectly via a decentralized control unit or directly to the central control unit. Usually, the central control unit coordinates all flushing processes in a building and evaluates the temperature signals described below. A cable connection of sensors and valves for monitoring and regulating the drinking water system can also be realized via decentralized controls distributed throughout the building. These decentralized controls in turn can be an integral part of a complete unit, which can also contain sensors and valves. Automated flushing processes can be programmed via a time module integrated in the central control unit. In addition, a water temperature measured by a temperature sensor can be transmitted to the central control unit. Depending on the measured temperature, the period of the flushing cycles can be adjusted so that, for example, in summer, when the pipes and the water in them heat up more quickly, flushing takes place at shorter time intervals than in winter. Depending on the building and pipe layout, however, the reverse may also be possible, so that in winter, due to the higher heating requirement, the drinking water also heats up more than desired and must therefore be flushed more frequently. The temperature has therefore proven to be a very useful parameter for sensible flushing, depending on the type of building and other external circumstances.

From DE 10 2011 013 955 A1 and EP 2 500 475 A2 a flushing device is known which contains a temperature sensor for recording the chronological temperature profile of the water temperature in a drinking water pipeline. If this temperature sensor records a constant temperature profile over a specified period of time, a flushing process is activated by opening a flushing valve. If the temperature sensor does not record a constant temperature profile over a specified period of time, a flushing process is omitted in that the flushing valve remains closed.

If a drinking water pipeline remains unused for a longer period of time, the temperature of the standing water in it adapts to the ambient temperature. A thermal equilibrium is established between the environment and the drinking water pipeline. If the ambient temperature is in the range of the room temperature, the formation of germs such as *Legionella* is promoted. Flushing of the drinking water pipeline is then required with regard to drinking water hygiene.

With the flushing device according to DE 10 2011 013 955 A1 and EP 2 500 475 A2, it may nevertheless be possible that such a flushing process is suspended. This is because adjusting the water temperature in the drinking water pipeline to the ambient temperature does not result in a constant temperature profile. Furthermore, the ambient temperature is not constant. When darkness or night falls, for example, the ambient temperature usually drops. This also reduces the temperature of water in the drinking water pipeline. The temperature profile of the drinking water in the drinking water pipeline is rarely constant over a certain period of time, even if it is not used. As shown, external influences can lead to the fact that the flushing device according to DE 10 2011013955 A1 and EP 2 500 475 A2 misinterprets the measured temperature profile, interprets a deviation from a constant temperature profile as a use by a consumer and interrupts a flushing process even though the drinking water pipeline has been used insufficiently or not at all.

The known state of the art offers room for improvement in terms of flushing efficiency.

One object of the present invention is therefore to provide a drinking and service water system that meets the hygienic requirements of a drinking water system with an efficient flushing device, and a method for flushing such a system.

BRIEF SUMMARY

The present invention provides a drinking and service water system with the features of claim 1 for the device solution of this object.

This drinking and service water system has a connection to the public water supply network through which at least the supply line leading to at least one consumer is supplied with fresh water. The flushing valve for draining water from the drinking and service water system is arranged downstream of the consumer in the flow direction and is connected in terms of control to a control unit which comprises a flushing module which specifies flushing processes to the control unit at specific times and/or at specific time intervals and/or as a function of measured temperatures. As a rule, the control unit controls a drive which, e.g. via an axially movable or a rotatably mounted actuator, places a valve body of the flushing valve relative to a valve seat of the flushing valve. Afterwards, flushing can be programmed into the control unit at defined times and/or at defined time intervals (e.g. every eight hours) and/or as a function of measured temperatures. Such pre-programming is usually referred to as the flushing schedule.

In addition, the drinking and service water system has a first temperature sensor upstream of the consumer in the flow direction. This sensor measures the water temperature in the supply line. A second temperature sensor is arranged between the consumer and the flushing valve. The control unit is adapted to decide, based on a temperature difference between a measured value of the first temperature sensor and a measured value of the second temperature sensor, whether a flushing process specified according to the flushing schedule should be carried out, omitted or postponed.

Usually, the time intervals between two flushing processes are selected in such a way that the water in the pipes does not develop into a critical temperature range in which bacteria formation is promoted, even in the absence of a consumer tapping process. The time intervals are usually fixed. In order to ensure that the critical temperature range is not reached, a temperature-controlled flush can be programmed into the flushing schedule in addition to or as an alternative to the pure time-controlled flush.

Before the critical temperature range is reached, the control unit initiates a flushing process, i.e. the flushing valve opens and then closes again when sufficient standing water has been drained from the system and replaced by fresh cold water. "Flushing" means an exchange of water standing in the pipe.

BRIEF DESCRIPTION OF THE DRAWINGS

The Figure is a schematic representation of an embodiment of the invention drinking and service water system.

DETAILED DESCRIPTION

Regular tapping or a single long-lasting tapping operation may eliminate the need for a programmed flushing process according to the flushing schedule. If flushing is carried out nevertheless, water is used unnecessarily. Typically, all the water upstream of the flushing valve in the upstream piping system is drained.

The present invention provides a solution to this problem.

If a consumer taps water from the system, the temperature in the supply line usually drops, as cold water flows in via the connection to the public water supply network. This causes a temperature difference between the measured values of the first and the second temperature sensor. This is because the second temperature sensor is arranged downstream the consumer in the flow direction, preferably assigned to the flushing valve and/or arranged directly in front of the flushing valve. While the temperature in the area of the first temperature sensor is reduced essentially instantaneously by the direct replacement of water in the pipe by cold water, in the area of the second temperature sensor a temperature equalization with the cold water which flows after the end of the tapping process and which remains in the pipe only gradually takes place by heat transfer (convection). As a rule, the area of the second temperature sensor is not directly flown through by the cold water flowing in. In this respect, the processes in these two areas take place on different time scales, which means that a temperature difference between the measured values of the first and the measured values of the second temperature sensor can be determined during a tapping process. The first and second temperature sensors usually measure continuously and are data connected to the control unit. A temperature difference between the measured values of the first temperature sensor and the measured values of the second temperature sensor is usually detected in the control unit at defined time intervals, usually not exceeding one minute. Usually the control unit contains a logic unit, which determines a temperature difference by calculating the difference between the measured value of the first and the measured value of the second temperature sensor, whereby the difference may be recorded or stored. The calculation of the difference can preferably be carried out continuously.

In this way, the control unit can draw conclusions about the user behavior of the consumers. These conclusions flow into the decision of the control unit as to whether a flushing process should be carried out, omitted or postponed. The invention causes a use-oriented change in the flushing schedule. The drinking and service water system according to the invention is less susceptible to external influences. This is because these have the same effect on both temperature sensors, so that their effects have no influence on the difference between the measured value of the first temperature sensor and the measured value of the second temperature sensor.

The present invention thus permits hygienically harmless operation of a drinking and service water system. If, for example, a significant tapping process takes place directly before a flushing process specified in the flushing schedule, i.e. a larger quantity of water is removed from the system by a consumer, the specified flushing process can be dispensed with or postponed. Because of the consumption-related exchange of water during a significant tapping process, sufficient fresh water flows into the system, so that the subsequent flushing process can be dispensed with in order to comply with the hygienic requirements. If the time interval to the next scheduled flushing process is too long, the scheduled flushing process and all subsequent flushing processes can only be postponed by a determined time. Typically, the period between the individual subsequent flushing processes is not changed.

A connection to the public water supply network in the sense of the present invention is in particular such an area of a drinking and service water system of a building which communicates directly with the domestic water meter but does not yet have a branch leading to one or more supply lines. The water drained via the flushing valve is usually discharged via a waste water pipe connected to a waste water outlet. Waste water outlet in the sense of the present invention is to be understood as the pipeline area of a drinking and service water system of a building which transfers the waste water to the public waste water network. The connection to the public water supply network as well as the waste water outlet are usually located directly adjacent to each other and on basement level. The supply line(s) usually have a nominal diameter of DN 20 or larger.

According to a preferred further embodiment, the control unit is adapted in such a way that the difference between the measured value of the first temperature sensor and the measured value of the second temperature sensor is formed at predetermined time intervals and stored in the control unit for a defined minimum period. The predetermined time intervals between two difference values are usually the same. The preferred time interval between two difference values is one minute or less. The defined minimum duration is preferably 24 hours.

According to a further preferred development of the present invention, the control unit adapted in such a way that a flushing process specified according to the flushing schedule can be suspended or postponed if the difference prior to the scheduled start time of the specified flushing process is at least 2.5° C., preferably at least 3° C., very preferably at least 3.5° C. and particularly preferably at least 4° C. If a difference is calculated which corresponds to these values, a significant tapping process is concluded.

According to a further preferred further development of the present invention, the control unit is adapted in such a way that the duration of a tapping process can be determined from the chronological sequence of the difference. The start time of a tapping process is usually the time from which the difference increases. The end time of the tapping process is usually the time from which the difference decreases. That the difference decreases again after a tapping process is due to the fact that the water temperature in the pipeline gradually balances by heat transfer. The duration of the tapping process is the duration between the start and end of the tapping process.

According to a further preferred further embodiment of the present invention, the control unit is adapted in such a way that a specified flushing process can be suspended or postponed if the sum of the duration of all, preferably significant, tapping processes in a specific time interval before the scheduled start time of a specified flushing process reaches or exceeds a defined limit value. The specific time interval before the scheduled start time can, for example, be one hour. The exact time interval is preferably adjustable and stored in the control unit. The limit value is also usually stored in the control unit and can preferably be set.

In this way, the decision of the control unit as to whether sufficient water has been exchanged due to the user behavior of the consumers can be improved. If the control unit decides that sufficient water has been exchanged due to the user behavior, it suspends or postpones the next planned flushing process.

According to another preferred further development of the present invention, at least two consumers are connected to the supply lines, whereby a further temperature sensor is arranged between these consumers. In this way, a usage profile can be created for each individual consumer. The additional temperature sensor fulfills the function of the first temperature sensor for the downstream consumer.

According to another preferred further embodiment of the present invention, the supply line comprises at least one story pipeline and a plurality of floor pipelines. As a rule, the story pipeline extends vertically over one or more stories. A floor pipeline usually does not extend beyond a single floor. Each floor pipeline contains at least one consumer and a temperature sensor upstream of the consumer in the flow direction. This allows a usage profile to be created for each individual floor. A flushing valve is also preferred at the end of each floor pipeline so that the individual floors can be flushed differently depending on their use.

The consumers can be connected to the supply line in a variety of ways. For example, a plurality of consumers can be connected to the supply line via a flow divider. Just as well, the connection can be realized via a T-piece installation or a ring installation. A supply line looped through between the connection to the public water supply network, the consumers and the flushing valve as a looped-through story installation is also conceivable.

Usually, a free drain is provided in the area of the water outlet. The free drain is usually characterized by the fact that the water travels a falling distance in the earth's gravity field, which either runs directly in the ambient atmosphere or is atmospherically connected to it. In this way it can be prevented that a possible backflow within a sewage pipe can get into the supply line. Usually, an overflow monitoring device is also provided in the area of the free drain. This device usually communicates with the control unit and/or a flow limiter assigned to the flushing valve, so that in the event of an impending overflow at the free drain, the outflow from the drinking and service water system can be regulated, reduced or even completely prevented. In addition or alternatively, the overflow monitoring system can issue a warning signal, for example optically or acoustically, and/or report it to a higher-level building control system.

According to a further preferred embodiment, the control unit is adapted in such a way that the difference between the measured value of the first temperature sensor and the measured value of the second temperature sensor in the control unit is compared with a reference value. The reference value can be a constant or a stored difference between the measured value of the first temperature sensor and the measured value of the second temperature sensor determined earlier. However, the reference value can also be a reference temperature difference that corresponds to a mean value or a median of a large number of difference values. The control unit is adapted in such a way that the specified flushing process is suspended, postponed or stopped if the difference is greater than the reference value.

The reference value is preferably a constant, for example 2.5° C., 3° C., 3.5° C. or 4° C.

According to an alternative preferred further development, the reference value is a stored difference between the measured value of the first temperature sensor and the measured value of the second temperature sensor. For the comparison between the difference and the reference value, for example, the difference determined at the same time of the previous day can be defined as the reference value.

According to a further alternative preferred further development, the reference value is a reference temperature difference that corresponds to the median of a large number of difference values. Preferably, the median is formed from the difference values determined at a time interval of one hour. For example, the last 23 difference values measured on the hour can be used to calculate the median.

According to a further, alternative, preferred further development, the reference value is a reference temperature difference which corresponds to the mean value of a plurality of difference values. Preferably, the oldest difference value included in the calculation of the mean value at the time of the calculation is 24 hours old or less. Furthermore, the mean value is preferably calculated at a preset time and usually stored until it is replaced or overwritten by the mean value calculated at the preset time on the following day.

According to a further alternative preferred further development, the reference value is a reference temperature difference corresponding to the mean value of a plurality of difference values, the mean value being formed from the calculated difference values of the previous day.

In order to solve the procedural problem, the present invention specifies a method for flushing a drinking and service water system. A temperature difference is formed between a temperature measured in an area upstream a flushing valve and a temperature measured in an area upstream of a consumer, on the basis which a control unit decides whether a flushing process is carried out, omitted or postponed. In particular, starting or resuming is to be understood as carrying out. In particular, an end or a non-start is to be understood as an omission.

The area in front of the consumer is generally understood to be a pipe section extending between the consumer and a connection to the public water supply network. The area upstream of the flushing valve is usually understood to be a pipe section extending between the flushing valve and the consumer. In these areas a temperature sensor is usually provided to measure the temperature. Preferably, a first temperature sensor is assigned directly to the consumer and a second temperature sensor is assigned directly to the flushing valve.

A flushing module of the control unit usually specifies the opening of the flushing valve at determined times and/or at determined time intervals and/or as a function of measured temperatures. Usually the difference between the measured values of the first and the second temperature sensor is formed. This can be formed and preferably stored as a function of time by measuring at discrete time intervals or by continuous measurement. The period to be considered for the decision on flushing is preferably adjustable.

The method according to the invention is preferably set up after one or a plurality of the further developments discussed above.

Further details and advantages of the present invention result from the following description of an embodiment in connection with The Figure, which shows a schematic representation of an embodiment of the invention drinking and service water system.

The Figure shows a schematic illustration of an embodiment of a drinking and service water system of a building not shown in detail. The drinking and service water system of the building has a connection 2 to the public water supply network in order to supply the building with fresh water. This fresh water is usually cold water. Connection 2 feeds a supply line that includes a story pipeline 4. The story pipeline 4 extends vertically from the basement or ground floor to a second floor. The first and second floors are each supplied with water by a floor pipeline 6, which is connected to a story pipeline 4 and runs horizontally on each floor. On each floor, three consumers 8 are connected to the floor line 6 via a ring installation. A flushing valve 10 is arranged at each end of the floor pipeline 6 downstream of the consumers 8 in the flow direction. The flushing valves 10 are connected to a control unit 12 for control purposes.

The control unit 12 contains a time module that gives the control unit 12 times at which the control unit opens the flushing valves 10. When the flushing valves 10 are open, water flows out of the drinking and service water system via a free drain 14 into a waste water pipeline 16. In floor pipeline 6, a first temperature sensor 18 is arranged upstream of the ring installation, upstream of the consumers 8 in the flow direction. The first temperature sensor 18 measures the water temperature in the floor pipeline 6 upstream of the consumers 8 and sends the measured temperature to the control unit 12. Fresh cold water flows through a tapping process of a consumer 8 from connection 2 via the story pipeline 4 into the floor pipeline 6. The fresh cold water flowing in usually has a lower temperature than the stale water in the floor pipeline. The measured temperature of the first temperature sensor 18 therefore usually drops in the event of a tapping of the consumer 8. A second temperature sensor 20 is assigned to the flushing valve 10 and is directly upstream of it in the flow direction. The second temperature sensor 20 also continuously measures the water temperature and sends the measured values to the control unit 12. The measured temperature of the second temperature sensor 20 usually changes on a different time scale than that of the first temperature sensor 18 during a tapping process of a consumer 8, since the fresh cold water does not flow directly through the pipe section in which the second temperature sensor 20 is located, as is the case with the first temperature sensor 18. The control unit 12 can therefore determine with an integrated logic that during a tapping process of a consumer 8 a temperature difference between the first temperature sensor 18 and the second temperature sensor 20 is set. If the temperature difference exceeds a preset limit value, e.g. 4° C., the control unit can suspend or postpone a flushing process specified by the time module. The control unit 12 may be adapted such that a plurality of such tapping processes in which the limit value is exceeded must be registered in a fixed time window of for example 4 hours before the scheduled start time of a specified flushing process to decide to suspend or postpone the specified flushing process.

In the floor pipeline 6 of the first floor, two further temperature sensors 22 are provided, each arranged between two consumers 8. The other temperature sensors 22 also continuously measure the water temperature and send the measured values to the control unit 12. The control unit 12 can compare the measured values of the further temperature sensors 22 with the measured temperatures of the second temperature sensor 20 in each case in order to create a separate usage profile for each individual consumer 8.

LIST OF REFERENCE NUMERALS

2 Connection to the public water supply network
4 Story pipeline
6 Floor pipeline
8 Consumer
10 Flushing valve
12 Control unit
14 Free drain
16 Sewer pipeline
18 First temperature sensor
20 Second temperature sensor
22 Further temperature sensor

The invention claimed is:

1. Drinking and service water system with a connection (2) to an associated public water supply network, at least one supply line (4, 6) leading to at least one consumer (8), a flushing valve (10), which is arranged downstream of the consumer (8) in the flow direction, for draining water from the drinking and service water system, a control unit (12) connected in terms of control to the flushing valve (10) and a first temperature sensor (18) arranged upstream of the consumer (8) in the flow direction, the control unit (12) comprising a flushing module which specifies flushing processes to the control unit (12) at specific times and/or at specific time intervals and/or as a function of a measured temperature, wherein a second temperature sensor (20) is arranged between the consumer (8) and the flushing valve (10), and in that the control unit (12) decides, on the basis of a temperature difference between a measured value of the first temperature sensor (18) and a measured value of the second temperature sensor (20), whether the specified flushing operation is to be carried out, omitted or postponed, wherein the control unit (12) forms a difference between the measured value of the first temperature sensor (18) and the measured value of the second temperature sensor at predetermined time intervals and stores the difference for a defined minimum duration, wherein the control unit (12) determines a duration of a tapping operation from the chronological sequence of the difference, and wherein the control unit (12) manages a specified flushing operation that can be suspended or postponed if the sum of the duration of all tapping operations in a specific time interval before a scheduled start time of the specified flushing operation reaches or exceeds a fixed limit value.

2. Drinking and service water system according to claim 1, characterized in that at least two consumers (8) are connected to the supply line (4, 6) and in that a further temperature sensor (22) is arranged between these consumers (8).

3. Drinking and service water system according to claim 1, characterized in that the supply line (4, 6) comprises at least one story pipeline (4) and a plurality of floor pipelines (6) and in that in each floor pipeline (6) at least one consumer (8), a temperature sensor (18) arranged upstream the consumer (8) in flow direction and a flushing valve (10) arranged downstream of the consumer (8) in flow direction are arranged.

4. Drinking and service water system with a connection (2) to an associated public water supply network, at least one supply line (4, 6) leading to at least one consumer (8), a flushing valve (10), which is arranged downstream of the consumer (8) in the flow direction, for draining water from the drinking and service water system, a control unit (12) connected in terms of control to the flushing valve (10) and a first temperature sensor (18) arranged upstream of the consumer (8) in the flow direction, the control unit (12)

comprising a flushing module which specifies flushing processes to the control unit (12) at specific times and/or at specific time intervals and/or as a function of a measured temperature, wherein a second temperature sensor (2) is arranged between the consumer (8) and the flushing valve (10), and in that the control unit (12) decides, on the basis of a temperature difference between a measured value of the first temperature sensor (18) and a measured value of the second temperature sensor (20), whether the specified flushing operation is to be carried out, omitted, or postponed, wherein the control unit (12) forms a difference between the measured value of the first temperature (18) and the measured value of the second temperature sensor at predetermined time intervals and stores the difference for a defined minimum duration, wherein the control unit compares the difference between the measured value of the first temperature sensor and the measured value of the second temperature sensor with a reference value and suspends, postpones or stops a specified flushing operation if the difference is greater than the reference value, and wherein the reference value is a reference temperature difference which corresponds to a stored difference between the measured value of the first temperature sensor and the measured value of the second temperature sensor.

5. Drinking and service water system according to claim 4, wherein at least two consumers (8) are connected to the supply line (4, 6) and in that a further temperature sensor (22) is arranged between these consumers (8).

6. Drinking and service water system according to claim 4, wherein the supply line (4, 6) comprises at least one story pipeline (4) and a plurality of floor pipelines (6) and in that in each floor pipeline (6) at least one consumer (8), a temperature sensor (18) arranged upstream the consumer (8) in flow direction and a flushing valve (10) arranged downstream of the consumer (8) in flow direction are arranged.

7. Drinking and service water system with a connection (2) to an associated public water supply network, at least one supply line (4, 6) leading to at least one consumer (8), a flushing valve (10), which is arranged downstream of the consumer (8) in the flow direction, for draining water from the drinking and service water system, a control unit (12) connected in terms of control to the flushing valve (10) and a first temperature sensor (18) arranged upstream of the consumer (8) in the flow direction, the control unit (12) comprising a flushing module which specifies flushing processes to the control unit (12) at specific times and/or at specific time intervals and/or as a function of a measured temperature, wherein a second temperature sensor (20) is arranged between the consumer (8) and the flushing valve (10), and in that the control unit (12) decides, on the basis of a temperature difference between a measured value of the first temperature sensor (18) and a measured value of the second temperature sensor (20), whether the specified flushing operation is to be carried out, omitted or postponed, wherein the control unit (12) forms a difference between the measured value of the first temperature sensor (18) and the measured value of the second temperature sensor at predetermined time intervals and stores the difference for a defined minimum duration, wherein the control unit compares the difference between the measured value of the first temperature sensor and the measured value of the second temperature sensor with a reference value and suspends, postpones or stops a specified flushing operation if the difference is greater than the reference value, and wherein the reference value is a reference temperature difference which corresponds to the median of a plurality of difference values.

8. Drinking and service water system according to claim 7, wherein the plurality of difference values are determined at a time interval of one hour.

9. Drinking and service water system according to claim 7, wherein at least two consumers (8) are connected to the supply line (4, 6) and in that a further temperature sensor (22) is arranged between these consumers (8).

10. Drinking and service water system according to claim 9, wherein the supply line (4, 6) comprises at least one story pipeline (4) and a plurality of floor pipelines (6) and in that in each floor pipeline (6) at least one consumer (8), a temperature sensor (18) arranged upstream the consumer (8) in flow direction and a flushing valve (10) arranged downstream of the consumer (8) in flow direction are arranged.

11. Drinking and service water system with a connection (2) to an associated public water supply network, at least one supply line (4, 6) leading to at least one consumer (8), a flushing valve (10), which is arranged downstream of the consumer (8) in the flow direction, for draining water from the drinking and service water system, a control unit (12) connected in terms of control to the flushing valve (10) and a first temperature sensor (18) arranged upstream of the consumer (8) in the flow direction, the control unit (12) comprising a flushing module which specifies flushing processes to the control unit (12) at specific times and/or at specific time intervals and/or as a function of a measured temperature, wherein a second temperature sensor (20) is arranged between the consumer (8) and the flushing valve (10), and in that the control unit (12) decides, on the basis of a temperature difference between a measured value of the first temperature sensor (18) and a measured value of the second temperature sensor (20), whether the specified flushing operation is to be carried out, omitted or postponed, wherein the control unit (12) forms a difference between the measured value of the first temperature sensor (18) and the measured value of the second temperature sensor at predetermined time intervals and stores the difference for a defined minimum duration, wherein the control unit compares the difference between the measured value of the first temperature sensor and the measured value of the second temperature sensor with a reference value and suspends, postpones or stops a specified flushing operation if the difference is greater than the reference value, and wherein the reference value is a reference temperature difference which corresponds to the mean value of a plurality of difference values.

12. Drinking and service water system according to claim 11, wherein the oldest difference value, which finds entry into the calculation of the mean value, dates back at most 24 hours.

13. Drinking and service water system according to claim 12, wherein the mean value is calculated at a preset time.

14. Drinking and service water system according to claim 11, wherein the mean value is calculated and stored until replaced or overwritten by a mean value calculated at a preset time on a following day.

15. Drinking and service water system according to claim 11, wherein the mean value is formed from the determined values of the previous day.

16. Drinking and service water system according to claim 11, wherein at least two consumers (8) are connected to the supply line (4, 6) and in that a further temperature sensor (22) is arranged between these consumers (8).

17. Drinking and service water system according to claim 11, wherein the supply line (4, 6) comprises at least one story pipeline (4) and a plurality of floor pipelines (6) and in that in each floor pipeline (6) at least one consumer (8), a temperature sensor (18) arranged upstream the consumer (8) in flow direction and a flushing valve (10) arranged downstream of the consumer (8) in flow direction are arranged.

* * * * *